US005610619A

United States Patent [19]

Zafar

[11] Patent Number: 5,610,619

[45] Date of Patent: Mar. 11, 1997

[54] BACKLITE ANTENNA FOR AM/FM AUTOMOBILE RADIO HAVING BROADBAND FM RECEPTION

[75] Inventor: Imtiaz Zafar, Carmel, Ind.

[73] Assignee: Delco Electronics Corporation, Kokomo, Ind.

[21] Appl. No.: 560,157

[22] Filed: Nov. 20, 1995

[51] Int. Cl.[6] ..... H01Q 1/32

[52] U.S. Cl. ..... 343/713; 343/704; 343/860

[58] Field of Search ..... 343/704, 713, 343/858, 860; H01Q 1/32

[56] References Cited

U.S. PATENT DOCUMENTS

| | | | |
|---|---|---|---|
| 4,439,771 | 3/1984 | Kume et al. | 343/713 |
| 4,583,097 | 4/1986 | Kropielnicki | 343/704 |
| 4,803,492 | 2/1989 | Inaba et al. | 343/713 |
| 4,903,035 | 2/1990 | Kropielnicki et al. | 343/704 |
| 4,928,108 | 5/1990 | Kropielnicki et al. | 343/704 |
| 4,992,801 | 2/1991 | Saito et al. | 343/713 |
| 5,029,308 | 7/1991 | Lindenmeier et al. | 343/704 |
| 5,083,134 | 1/1992 | Saitou et al. | 343/704 |
| 5,099,250 | 3/1992 | Paulus et al. | 343/704 |
| 5,119,106 | 6/1992 | Murakami | 343/713 |
| 5,198,825 | 3/1993 | Sakurai et al. | 343/713 |
| 5,231,408 | 7/1993 | Nakase | 343/713 |
| 5,239,303 | 8/1993 | Hirotsu et al. | 343/713 |
| 5,293,173 | 3/1994 | Kropielnicki et al. | 343/704 |
| 5,334,989 | 8/1994 | Nagayama et al. | 343/713 |

FOREIGN PATENT DOCUMENTS

| | | | |
|---|---|---|---|
| 3906592 | 5/1994 | Germany . | |
| 4323239 | 1/1995 | Germany . | |
| 0070101 | 3/1990 | Japan | H01Q 1/32 |

OTHER PUBLICATIONS

Taniguchi, Tatsuaki, et al. "Development of Capacitance--Loaded Window Antenna For AM/FM Car Radios," SAE Technical Paper Series 950180, pp. 1–8 (1995).

*Primary Examiner*—Donald T. Hajec
*Assistant Examiner*—Tan Ho
*Attorney, Agent, or Firm*—Jimmy L. Funke

[57] ABSTRACT

A backlite antenna system for an AM/FM vehicle stereo where the antenna system includes an antenna grid embedded in a rear window of the vehicle, that is electrically separate from a heater grid embedded in the rear window. The antenna grid includes a plurality of equally spaced, horizontal antenna elements that extend almost the entire width of the rear window of the vehicle. Two vertical end bus bars and two vertical center bars connect the antenna elements. An FM tuning stub is connected to the antenna elements for appropriate FM reception depending on the type of vehicle body. The antenna grid also includes an L-shaped element connected to one of the end bus bars and extending between the antenna grid and the heater grid, and a T-shaped element connected to one of the vertical center bars and also extending between the antenna grid and the heater grid. Also, two of the antenna elements are separated and connected by vertical connecting antenna elements. This configuration provides broadband FM reception in the frequency range of 76 MHz to 108 MHz. An antenna module housing a matching circuit, and possibly an amplifier circuit, is located in the header of the vehicle adjacent to the vehicle window.

18 Claims, 3 Drawing Sheets

BACKLITE ANTENNA FOR AM/FM AUTOMOBILE RADIO HAVING BROADBAND FM RECEPTION

BACKGROUND OF THE INVENTION

1. Field of the Invention

This invention relates generally to an antenna system for a vehicle radio and, more particularly, to a backlite antenna system for a vehicle radio in which antenna elements are embedded in a rear window of the vehicle and are separate from defogger elements embedded in the rear window, and where the antenna system provides broadband FM reception.

2. Discussion of the Related Art

Most vehicles include a vehicle radio that requires some type of antenna system to receive amplitude modulation (AM) and frequency modulation (FM) broadcasts from various radio stations. Most present day vehicle antenna systems include a mast antenna that extends from a vehicle fender, vehicle roof, or some applicable location on the vehicle. Although mast antennas provide acceptable AM and FM reception, it has been recognized by vehicle manufacturers for many years that the performance of a mast antenna cannot be further enhanced, i.e., provide increased AM and FM reception capabilities over the current state of the art reception. Therefore, improvements attained in all other areas of in-vehicle entertainment systems will not include reception capabilities of the mast antenna. Consequently, car manufacturers have sought other types of antenna designs to keep pace with demands in increased vehicle stereo and radio capabilities.

Improvements in vehicle antenna systems have included development of backlite antenna systems in which antenna elements are embedded in a rear window of the vehicle in various manners. As is understood, such a backlite antenna system can have improved reception performance for both AM and FM reception over mast antenna systems. Backlite antenna systems have also provided a number of other advantages over mast antenna systems, including, no wind noise, reduced drag on the vehicle, elimination of corrosion of the antenna, no performance change with time, no risk of vandalism, and reduced cost of installation.

Typically, known backlite antenna systems utilize defogger elements already encapsulated in the back window of the vehicle as antenna elements to receive the AM and FM broadcasts. Examples of such backlite antenna systems can be found in U.S. Pat. No. 5,293,173 issued to Kropielnicki, et al. Mar. 8, 1994, and U.S. Pat. No. 5,099,250 issued to Paulus, et al. Mar. 24, 1992. For the known combination defogger/antenna element systems embedded in rear windows of vehicles, it has been necessary to incorporate two bifilar or toroidal chokes between the elements and the vehicle DC power supply so as to separate the antenna signals from the high current signals that heat the elements. These chokes provide low impedance paths for the propagation of the relatively large current flow necessary to power the elements, and a high impedance path against the propagation of the radio signals. A first choke of a relatively small inductance is generally used for the FM range, and a second choke having a much larger inductance, generally greater than 1 mH, is generally used for the AM range. For lower frequencies, the impedance of a typical heater element relative to the metal of the vehicle body approaches that of its capacitance. The use of the choke is important to eliminate the DC magnetism present from this capacitance.

Use of these types of chokes to separate the antenna signals from the high current signals that heat the defogger/antenna elements includes a number of disadvantages for these types of known backlite antenna systems. Particularly, the chokes are heavy, expensive and cumbersome to implement. Therefore, use of such chokes has been less than desirable.

Other disadvantages of utilizing already existing defogger elements as antenna elements of an antenna system also exist. For one particular disadvantage, the length of the defogger elements across the width of the window sometimes causes end bus bar elements to contact conductive glue that secures the window to the vehicle body, or cause the bus bar elements to be close to the sheet metal of the vehicle body. This creates a capacitance to ground connection resulting in a degradation of AM performance of the antenna elements. Therefore, the defogger elements must be reduced in length (positioned inboard) for proper AM performance for certain vehicle body styles. This reduction in length makes the end bus bars visible on the window, reducing its aesthetic appearance. Therefore, some times additional costs are incurred to change trim members around the window to cover these end bus bars.

Another drawback of utilizing already existing defogger elements as antenna elements has to do with high currents that are desirable, on the order of 30 amps, for quickly defogging the window of the vehicle. These high currents are applied to the matching network of the antenna elements. Because high currents will adversely effect at least some of the components in the matching network, this current is limited to a maximum current. This maximum current may be below what is desired for a particular defogging application.

The bifilar chokes used in the prior art backlite antenna systems are generally incorporated in an antenna impedance matching network. The impedance matching network is necessary in these types of antenna systems to match the output of the antenna elements to the input of an amplifier associated with the vehicle radio so as to reduce the attenuation of power transfer from the antenna elements to the radio. Known impedance matching networks typically have not been universal in that the network components or network design must be changed from vehicle to vehicle to realize the greatest efficiency in impedance matching. This is because the capacitance created between the elements and the vehicle body varies from vehicle to vehicle. Further, prior art antenna grid patterns are directional at FM frequencies, and have low gain at AM frequencies.

FM transmissions in the United States are within a well regulated frequency range of 88 MHz to 108 MHz. Therefore, antennas associated with vehicles operating in the United States are tuned to this particular bandwidth. However, other countries may operate within different regulated bandwidths for their FM transmissions. For example, Japan regulates FM transmissions in the frequency bandwidth of 76 MHz to 90 MHz. Therefore, antennas associated with vehicles operating in Japan are tuned to this particular bandwidth. It would therefore be desirable that vehicles that are sold and/or operated in both the United States and Japan would include an antenna that was tuned to FM broadcasts in the bandwidth of 76 MHz to 108 MHz so as to eliminate the need to provide different antenna systems for the same type of vehicles operated in both the U.S. and Japan.

What is needed is a backlite antenna system for an AM/FM vehicle radio that does not include chokes, includes an antenna responsive to a wide bandwidth for operation in multiple countries, and includes a matching network that can be incorporated into a wide variety of vehicles. It is therefore an object of the present invention to provide such an antenna system.

SUMMARY OF THE INVENTION

In accordance with the teachings of the present invention, a backlite antenna system for an AM/FM vehicle radio is disclosed in which antenna elements of the antenna system are embedded in a rear window of the vehicle, and are separate from the defogger elements used to defog the rear window of the vehicle. The antenna elements extend almost the entire width of the rear window of the vehicle for appropriate AM reception. A tuning stub is incorporated for suitable FM reception. Two vertical end bus bars and two vertical center elements connect the antenna elements. The location and length of the vertical elements and the tuning stub can be adjusted for appropriate FM reception depending on the type of vehicle body. In one embodiment, the antenna elements include an extending L-shaped element and T-shaped element to provide tuning for a wide band FM signal. Also, two of the antenna elements are separated at a particular location, and connected together by vertical connecting elements. An antenna module housing a matching circuit is located proximate the window.

Additional objects, advantages, and features of the present invention will become apparent from the following description and appended claims, taken in conjunction with the accompanying drawings.

DETAILED DESCRIPTION OF THE PREFERRED EMBODIMENTS

The immediately following discussion of the invention is directed to a broadband backlite antenna system as disclosed in U.S. patent application Ser. No. (Attorney Docket No. H-194379) referenced above. This discussion is merely exemplary in nature and is in no way intended to limit the invention or its applications of uses.

Figure 1:
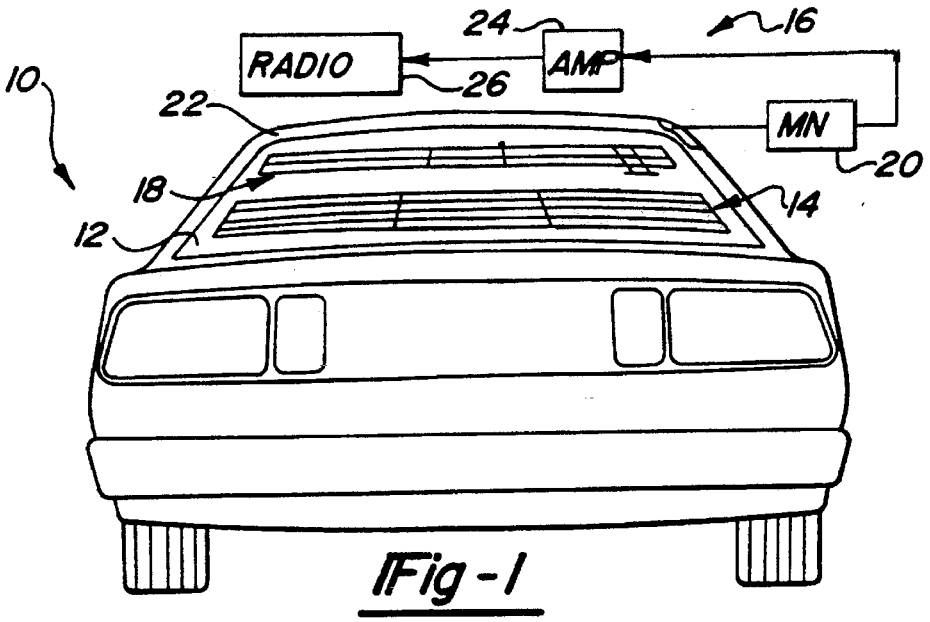
FIG. 1 is a back view of a vehicle incorporating a backlite antenna system according to an embodiment of the present invention.

FIG. 1 shows a back view of a vehicle 10 including a rear window 12. A defogger grid 14 is embedded within a bottom portion of the rear window 12 and extends across the width of the window 12. The defogger grid 14 is heated by an appropriate defogger system (not shown) so as to heat the elements of the grid 14 and eliminate condensation and ice from the window 12, as is well understood in the art. Because the defogger grid 14 includes strips of a conductive material that are responsive to electrical signals, it has heretofore been known to simultaneously use the defogger grid 14 to receive AM and FM signals to be sent to a vehicle radio associated with the vehicle 10. As discussed above, antenna systems of this type have a number of drawbacks that can be improved upon.

In accordance with the teachings of the present invention, an antenna system 16 is disclosed that includes an antenna grid 18 embedded in the rear window 12 above and separate from the defogger grid 14. AM and FM signals received by the antenna grid 18 are sent to an antenna module 20 secured within a header 22 of the vehicle 10, as shown. The antenna module 20 includes a matching network (not shown in FIG. 1) that impedance matches the output from the antenna grid 18 to an amplifier 24 associated with a vehicle radio 26 so as to reduce the attenuation of power transferred from the antenna grid 18 to the amplifier 24. Although the module 20, the amplifier 24 and the radio 26 are shown removed from the vehicle 10, it will be understood that the module 20 is embedded within the header 22 adjacent to the grid 18. The amplifier 24 and the radio 26 can be located within a passenger compartment of the vehicle 10. However, the amplifier 24 can be included within the module 20 along with the matching network (MN). As will be discussed in detail below, the antenna system 16 provides a number of advantages over prior art backlite antenna systems.

Figure 2:
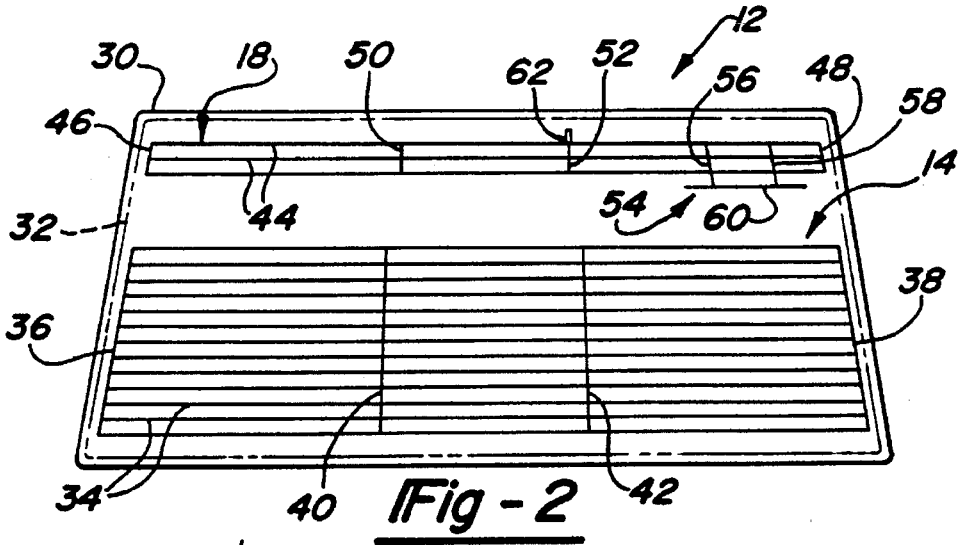
FIG. 2 is a diagrammatic view of antenna elements embedded in the rear window of the vehicle of FIG. 1 depicting one embodiment of the antenna system of the invention.

FIG. 2 shows a diagrammatic plan view of the rear window 12 of the vehicle 10. An outer perimeter line 30 defines the glass perimeter of the window 12. A dotted line 32 represents body sheet metal of the vehicle 10 that overlaps the window 12. The defogger grid 14 includes a plurality of parallel, horizontal, equally spaced apart defogger elements 34 at a lower location in the window 12. The horizontal defogger elements 34 are connected at each end by two opposing vertical defogger bus bars 36 and 38. One important feature of the invention is the use of two vertical shorting bars 40 and 42 that are symmetrically positioned and connected to the horizontal elements 34 at a central location of the grid 14. An electrical current is applied to the grid 14 to one of either of the vertical bus bars 36 or 38 so as to heat the elements 34, and thus the window 12. The opposite vertical bus bar 36 or 38 will be grounded. The vertical shorting bars 40 and 42 are grounded so as to ground the center portion of the horizontal elements 34 of the grid 14 to make the elements 34 have a consistent ground reference plane across their entire length. Additionally, the shorting bars 40 and 42 counter the effects of parasitic resonances present in the FM antenna characteristic impedance, and minimizes the effects of cross polarization thereby resulting in an omni-directional polar response at FM frequencies.

The antenna grid 18 includes three horizontal, parallel, equally spaced apart antenna elements 44 extending substantially the entire length of the window 12, as shown. The antenna elements 44 are electrically connected together at both of their ends by antenna element bus bars 46 and 48. Also, the antenna elements 44 are electrically connected together by two centrally located vertical center elements 50 and 52. At one end of the grid 18 is a tuning grid 54 including two vertical tuning elements 56 and 58 connected to a horizontal tuning stub 60, as shown. The tuning grid 54 is an important feature of the invention for providing proper FM reception for a wide variety of vehicle body styles. The bus bars 36 and 38, the shorting bars 40 and 42, the antenna element bus bars 46 and 48, the center elements 50 and 52, and the vertical tuning elements 56 and 58 are parallel to the body sheet metal 32.

An antenna feed line 62 electrically connected to the center element 52 transmits the received AM and FM signals to the module 20 to be sent to the vehicle radio 26. It is generally important that the antenna module 20 be placed near the connection of the feed line 62 to the antenna grid 18 to minimize losses due to impedance mismatch and long cable runs. For this reason, the module 20 is located in the header 22. In one embodiment, the antenna feed line 62 is an insulated wire having a length less 300 mm. However, the length of the feed line 62 may vary from vehicle to vehicle, and may exceed 300 mm. An alternate approach would be to house the matching network components and the AM bypass in a coaxial cable. This method is extremely flexible from a packaging standpoint in that it allows the antenna module 20 to be placed in areas like the rear package shelf of the vehicle 10 where space constraints may not be an issue.

The antenna elements 44 are made of an electrically conductive material that is responsive to AM and FM radio signals that are broadcast from an appropriate transmitter (not shown). The elements 44 are appropriately dimensioned to be consistent with half-wavelength reception such that they are applicable to receive the frequencies appropriate for vehicle radios. To provide proper reception, it is important that the capacitances between the antenna elements 44 and the body sheet metal 32, and between the antenna elements 44 and the defogger elements 34 be tightly controlled. For example, the antenna elements 44 should be appropriately spaced on the glass of the window 12 so that the capacitance that is created between the defogger elements 34 and the antenna elements 44 is nearly the same as the capacitance between the antenna elements 44 and the body sheet metal 32.

It is desirable that the elements 44 be made as long as possible between the vertical edges of the window 12 so as to be appropriate for AM reception. The positions of the vertical elements 50 and 52, and the position and length of the horizontal tuning stub 60 are set to provide desirable FM reception at the FM frequencies of the vehicle radio 26 for a particular body style of vehicle. In other words, the positions of the vertical elements 50 and 52, and the length of the vertical tuning stub 60 may vary from vehicle to vehicle to provide elements having the necessary length for appropriate FM reception. These variances change the distance between the bus bar 46 and the center element 50, the center elements 50 and 52, and the center element 52 and the bus bar 48 for the appropriate reception. In one embodiment, the elements 44, the center elements 50 and 52 and the tuning grid 54 are configured and dimensioned to provide FM reception between 88–108 MHz with low insertion losses, high quality factor Q and an acceptable voltage standing wave ratio (VSWR). The quality factor Q is a measure of the lossyness of the antenna grid related to the energy that can be stored in the grid, and the VSWR is the relative magnitude of reflected waves in the grid.

Figure 3:
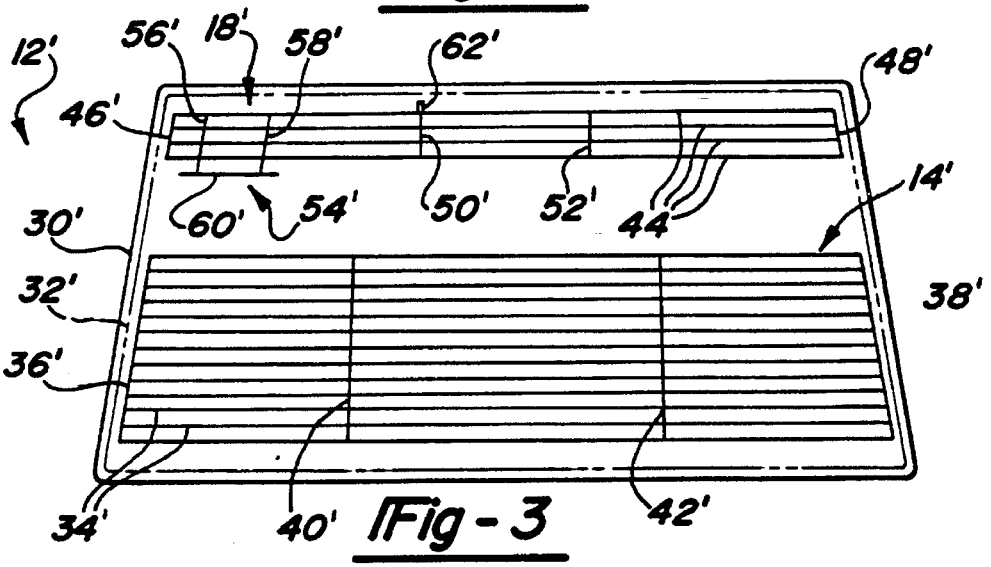
FIG. 3 is a diagrammatic view of antenna elements embedded in the rear window of the vehicle of FIG. 1 depicting another embodiment of the antenna system of the invention.

Therefore, the specific configuration of the antenna grid 18 may change between vehicle to vehicle. FIG. 3 shows a diagrammatic plan view of a rear window 12' intended to represent an alternate to the rear window 12 of the vehicle 10. In FIG. 3, identical elements to that of FIG. 2 are labeled accordingly followed by a prime. The difference between the configuration of FIG. 2 and the configuration of FIG. 3 is that there are four antenna elements 44' as opposed to three antenna elements 44, and the tuning grid 54' is positioned at a left side of the grid 18'. Four antenna elements 44' provides a way in which the distance between the antenna grid 18' and the defogger grid 14' can be controlled for different vehicle body designs. Other numbers, such as two and five, of antenna elements may be applicable for other vehicle designs. Further, the antenna feed 62' is electrically connected to the vertical element 50'.

Dimensions of the specific elements of FIGS. 2 and 3 can vary between vehicle body designs for proper AM and FM reception. In one embodiment, the elements 44 have a thickness of 0.8 mm, the bus bars 46 and 48 have a thickness of 5.0 mm, the distance between the body sheet metal 32 and the top element 44 is 38.0 mm, the distance between the elements 44 is 25.4 mm, the distance between the vertical center elements 50 and 52 is 280.0 mm and are symmetrical about a center line, the distance between the vertical elements 56 and 58 is 108.0 mm, the length of the horizontal tuning stub 60 is 203.0 mm, the distance between the vertical tuning stub 58 and the vertical bus bar 48 is 83.0 mm, and the distance between the shorting bars 40 and 42 is 330.0 mm and are symmetrical about the common center line.

Differences between the dimensions of the embodiments of FIG. 3 to that of the embodiment of FIG. 2 include: the distance between the vertical elements 50' and 52' is 279.4 mm about a center line; the length of the tuning grid vertical elements 56' and 58' is 101.6 mm; the distance between the top element 44' and the top sheet metal is 30.0 mm; the length of the horizontal tuning stub 60' is 140.0 mm; and the distance between the shorting bars 40' and 42' is 508.0 mm about a common center line. It will be appreciated by those skilled in the art that these dimensions may vary from vehicle body design to vehicle body design.

Figure 4:
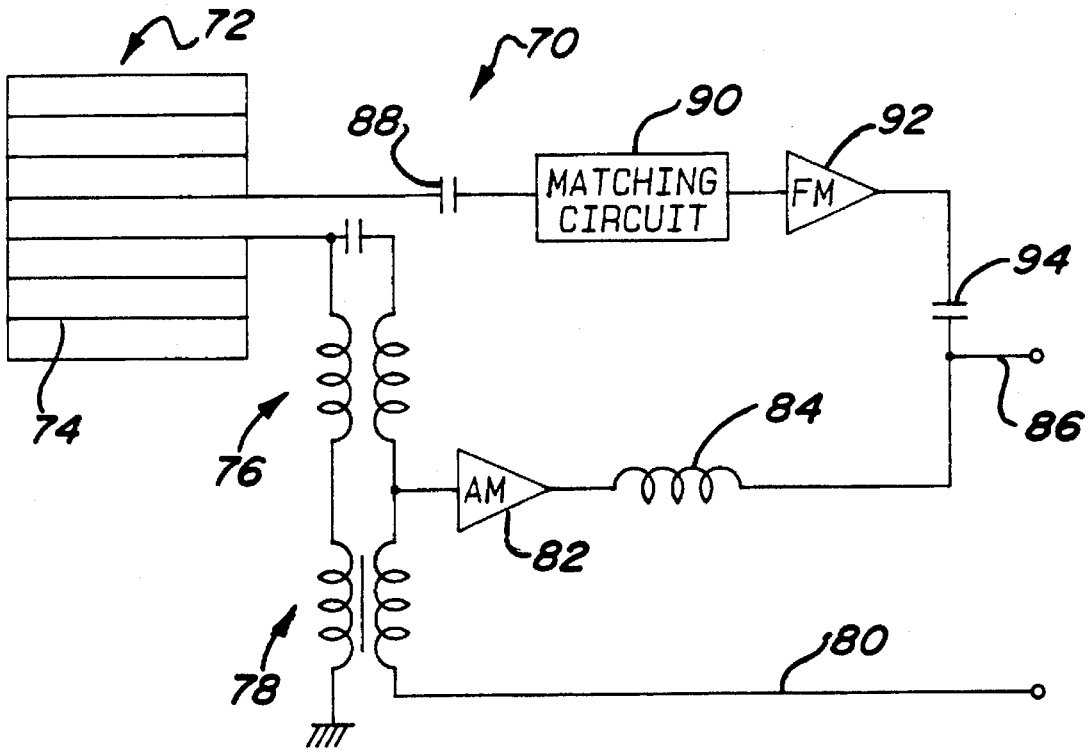
Fig-4 PRIOR ART
FIG. 4 is a prior art schematic diagram of a matching circuit for a prior art backlite antenna system.

The antenna system 16 of the present invention provides a number of advantages not found in the prior art. In one advantage, because the antenna grid 18 is separate from the defogger grid 14, it is not necessary to separate the antenna signals from the high current signals that heat the defogger grid elements 34. Therefore, expensive, cumbersome and heavy bifilar chokes are not necessary in the antenna matching circuit that matches the impedance of the output of the antenna elements to the impedance of the amplifier associated with the vehicle radio. To further discuss this advantage, FIG. 4 shows a prior art antenna system 70 that includes a defogger/antenna grid 72 having elements 74 that operate as a defogger for the rear window of a vehicle, and as AM and FM frequency reception for the vehicle radio. The system 70 includes a first bifilar choke 76 and a second bifilar choke 78. A high current heater signal is applied to line 80 to heat the elements 74 of the grid 72 to provide the defogging function. AM and FM radio signals received by the elements 74 are prevented from returning on the line 80 by the chokes 76 and 78. The choke 76 is an FM choke that provides a low impedance path to the high current heater signal, and a high impedance path to FM radio signals. The choke 76 has a relatively small inductance effective for the high frequency range of the FM signals. The choke 78 acts to prevent the lower frequency AM signals from traveling to ground, and thus acts as a low impedance path to the signal on line 80, and a high impedance path to the AM radio signals.

AM signals are applied through an AM buffer amplifier 82 and a filtering inductor 84 to an output line 86 to be sent to an amplifier associated with a vehicle radio. Likewise, FM signals are applied through a capacitor 88 to a matching circuit 90, that matches the impedance of the elements 80 with the impedance of the radio amplifier, and then through an FM buffer amplifier 92 and a filtering capacitor 94. The operation of the antenna system 70 is well understood in the art.

Figure 5:
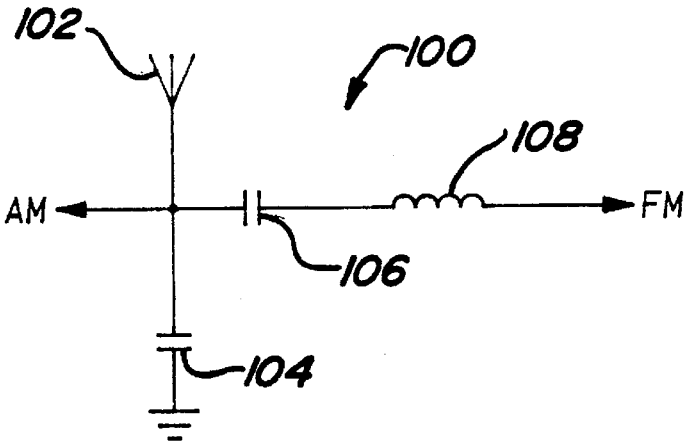
FIG. 5 is a schematic diagram of a matching circuit for the antenna system of the present invention as shown in FIGS. 2 and 3.

FIG. 5 shows a schematic diagram of a matching circuit 100 of the present invention that is included within the module 20. The matching circuit 100 provides impedance matching between the antenna grid 18 and the amplifier 24 in the range of 88 MHz to 108 MHz. The matching circuit 100 provides a matching circuit that can be used across as wide variety of vehicle designs. An antenna 102 represents the antenna grid 18 and the feed line 62. AM and FM signals received by the antenna 102 are impedance matched by the circuit 100 to be sent to the amplifier 24 of the vehicle radio 26 with minimal power loss. A shunt capacitor 104 positioned between the antenna 102 and ground moves a complex admittance downward (clockwise) on a Smith chart along a constant conductance circle for a distance that is equal to the susceptance (reciprocal of reactance) of the capacitor 104. As is understood in the art, the Smith chart is an impedance chart that gives a graphical indication of the impedance of a transmission line as one moves along the line. A capacitor 106 and an inductor 108 tune the FM signals received by the antenna 102 to the desired bandwidth such that the signals received by the vehicle radio will be limited to these bandwidths. The inductor 108 neutralizes the capacitive susceptance, and when combined with the capacitance of the capacitor 106, forms a series resonant circuit by presenting a complex conjugate match to the antenna load admittance. The matching circuit 100 also acts as a trap against AM signals entering the FM part of the circuit 100, and AM signals going to ground. In one embodiment, the value of the capacitors 104 and 106 is 18 pf, and the value of the inductor 108 is 0.27 μH. However, the values of the capacitors 104 and 106, and the inductor 108 can be changed for different vehicle designs to accommodate specific vehicle body styles.

Figure 6:
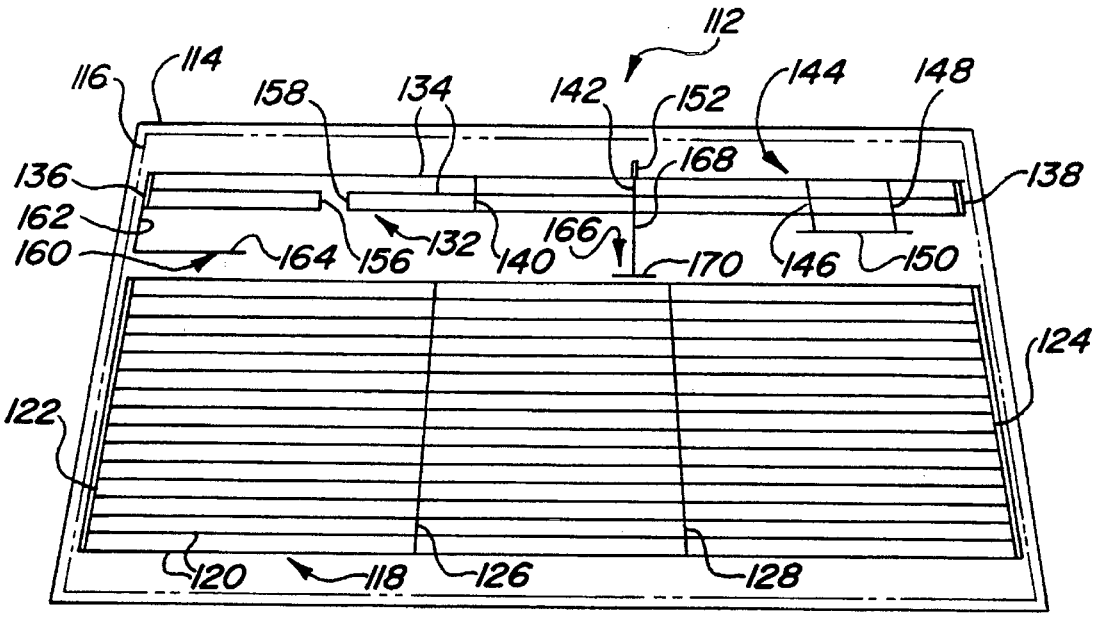
FIG. 6 is a diagrammatic view of antenna elements embedded in the rear window of the vehicle of FIG. 1 depicting another embodiment of the antenna system of the invention that is responsive to a wide FM bandwidth.

The following discussion is directed to the embodiments of applicant's new invention. FIG. 6 shows a diagrammatic plan view of a rear window 112 configured to be a rear window of the vehicle 10 and replace the rear window 12. An outer perimeter line 114 defines a glass perimeter of the window 112. A dotted line 116 represents body sheet metal of the vehicle 10 that overlaps the window 112. A defogger grid 118 includes a plurality of parallel, horizontal, equally spaced apart defogger elements 120 at a lower location in the window 112. The horizontal defogger elements 120 are connected together at each end by two opposing vertical defogger bus bars 122 and 124. An important feature of the invention is the use of two vertical shorting bars 126 and 128 that are symmetrically positioned and connected to the horizontal elements 120 at a central location on the grid 118, as shown. As is apparent, the defogger grid 118 is the same as the defogger grid 14, discussed above, and operates in the same manner.

An antenna grid 132 is embedded in the window 112 at an upper location above the defogger grid 118. The antenna grid 132 includes three horizontal, parallel, equally spaced apart antenna elements 134 extending substantially the entire width of the window 12, as shown. The antenna elements 134 are electrically connected together at both of their ends by antenna element bus bars 136 and 138. Also, the antenna elements 134 are electrically connected by two centrally located vertical center elements 140 and 142. At one end of the grid 132 is a tuning grid 144 including two vertical tuning elements 146 and 148 connected to a horizontal tuning stub 150, as shown. The tuning grid 144 is an important feature of the invention for providing proper FM reception for a wide variety of vehicle body styles. An antenna feed line 152 is electrically connected to the center element 142 to transmit the received AM and FM signals to the module 20 to be sent to the vehicle radio 26. The defogger bus bars 122 and 124, the shorting bars 126 and 128, the antenna element bus bars 136 and 138, the vertical center elements 140 and 142, and the vertical tuning elements 146 and 148 are all generally parallel to the closest side body sheet metal 116, as shown. As is apparent, the discussion thus far of the antenna grid 132 has matched that of antenna grid 18 above. In this regard, the requirements of the position of the module 20, and other requirements discussed above are equally important to the antenna grid 132.

The antenna grid 18 was designed to receive FM transmissions in the bandwidth of 88 MHz to 108 MHz. However, as is understood by those skilled in the art, other countries regulate their FM transmissions over other bandwidths. For example, Japan regulates FM transmissions in the range of 76 MHz to 90 MHz. Therefore, it is desirable to have an antenna grid that is responsive to transmissions in the range of 76 MHz to 108 MHz to allow it to be used for both Japanese FM transmissions and U.S. FM transmissions, so the same antenna system can be used for the same vehicle type that is to be operated in both the U.S. and Japan. Consequently, the antenna grid 18 must be modified to extend the bandwidth to this range, or another wide bandwidth range, and still maintain acceptably low insertion losses, and a desirable quality factor Q and VSWR. The antenna grid 132 will be described for receiving FM transmissions in the bandwidth 76 MHz to 108 MHz for use at both U.S. and Japanese FM transmissions. However, it is stressed that the design of the antenna grid 132 can be extended to other wide band FM frequency ranges.

As the bandwidth of an antenna increases, the quality factor Q will decrease resulting in more insertion losses, and a higher VSWR. In order to make the antenna grid 132 act as a wide bandwidth device so as to resonate at a wide bandwidth to receive broadband FM transmissions, and also appear to be a small bandwidth resonant device to maintain the quality factor Q, additional resonant elements are added to the antenna grid 132 to increase the bandwidth over the antenna grid 18, but maintain an acceptable quality factor Q, VSWR, and insertion losses. These additional elements include breaking the length of the lower two antenna elements 134 and connecting them together by two vertical connecting elements 156 and 158, as shown. Additionally, an L-shaped element 160 having a vertical element 162 and a horizontal element 164 is connected to the vertical bus bar 136, as shown. A T-shaped element 166 is connected to the center element 142 opposite to the feed line 152, and extends down towards the defogger grid 118, as shown. The T-shaped element 166 includes a vertical element 168 and a horizontal T-element 170. The L-shaped element 160 and the T-shaped element 166 provide tuning applicable to make the antenna grid 132 responsive to broadband FM signals.

In one embodiment, the downwardly extending element 162 is 65 mm long, the horizontally extending element 164 is 155 mm long, the downwardly extending element 168 is 88 mm long, the distance between the elements 156 and 168 is 38 mm, and the distance between the center element 140 and the vertical element 158 is 178 mm. Further, the length of the horizontal element 150 is 165 mm, the distance between the vertical tuning elements 146 and 148 is 114.3 mm, the distance between the end bar 138 and the vertical tuning element 148 is 88.9 mm, and the distance between the center elements 140 and 142 is 229 mm. The remaining component dimensions are the same as that of the grid 18 or 18' discussed above.

Figure 7:
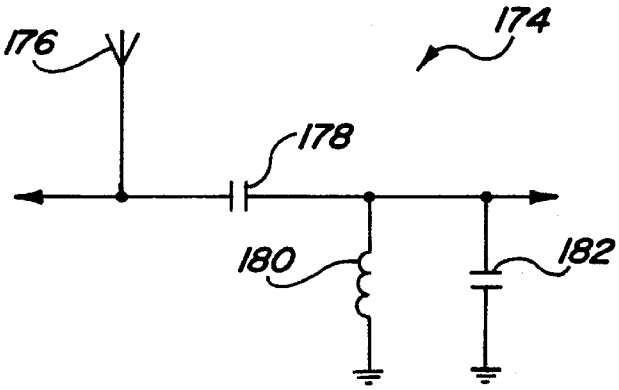
FIG. 7 is a schematic diagram of a matching circuit for the antenna system of the present invention as shown in FIG. 6.

The matching circuit 100 shown in FIG. 5 is applicable as a matching circuit for the antenna grid 132. However, as will be appreciated by those skilled in the art, other matching circuits are also applicable to impedance match the antenna grid 132 to the amplifier 24. For example, FIG. 7 shows a schematic diagram of an alternate matching circuit 174 of the present invention that impedance matches the antenna grid 132 to the amplifier 24. The matching circuit 174 provides impedance matching between the antenna grid 132 and the amplifier 24 in the range of 76 MHz to 108 MHz. An antenna 176 represents the antenna grid 132 and the feed line 152. AM and FM signals received by the antenna 176 are impedance matched to the circuit 174 to be sent to the amplifier 24 of the vehicle radio 26 with minimal power loss. A series capacitor 178 is positioned between an AM output and an FM output of the matching circuit 174, and moves a complex impedance downward (counterclockwise) on the Smith chart along a constant resistance circle for a distance that is equal to the reactance of the capacitor 178. An inductor 180 and a capacitor 182 are connected between the FM output and ground. The inductor 180 neutralizes the capacitive reactance, and is combined with the capacitor 182 to form a parallel resonant circuit by presenting a complex conjugate match to the antenna load impedance. The matching circuit 174 also acts as a trap against AM signals entering the FM part of the circuit 174, and AM signals going to ground.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

The embodiments of the invention in which an exclusive property or privilege is claimed are defined as follows:

1. An antenna system for a vehicle radio of a vehicle, said antenna system comprising:

an antenna grid embedded in a vehicle window of the vehicle, said antenna grid including a plurality of antenna elements that extend substantially across an entire width of the window, said antenna grid further including first and second end bus bars connecting the antenna elements at opposite ends, vertical center elements connecting the antenna elements at a central location, and a tuning grid, said tuning grid including two vertical tuning elements connected to the antenna elements and a tuning stub connected to the vertical tuning elements, wherein the antenna elements are separate elements than heater elements of a heater grid embedded in the vehicle window, said antenna grid further including an L-shaped element connected to the first bus bar and extending between the antenna grid and the heater grid, and a T-shaped element connected to one of the vertical center elements and extending between the antenna grid and the heater grid; and a matching circuit, said matching circuit being electrically connected to the antenna grid and being responsive to signals received by the antenna elements.

2. The antenna system according to claim 1 wherein a first and second antenna element of the plurality of antenna elements are separated and connected together by first and second vertical connecting antenna elements.

3. The antenna system according to claim 1 wherein the heater grid includes first and second shorting bars connecting heater elements of the heater grid at a central location.

4. The antenna system according to claim 1 wherein the matching circuit includes an antenna input, an AM output, an FM output, and a ground connection, said matching circuit further including a first capacitor connected between the AM output and the FM output, and a second capacitor and an inductor connected between the FM output and the ground connection.

5. The antenna system according to claim 1 wherein the antenna grid is embedded in the vehicle window at a location such that a capacitance generated between the antenna grid and the body sheet metal of the vehicle is substantially the same as a capacitance generated between the antenna grid and the heater grid.

6. The antenna system according to claim 1 wherein the antenna grid is embedded in the window at an upper location of the window and the heater grid is embedded in the window at a lower location of the window.

7. The antenna system according to claim 1 wherein the antenna grid and the heater grid are embedded within a rear window of the vehicle.

8. The antenna system according to claim 1 wherein the antenna system is tuned to an FM frequency range from 76 MHz to 108 MHz.

9. An antenna system for a vehicle radio of a vehicle, said antenna system comprising:

an antenna grid embedded in a vehicle window of the vehicle, said antenna grid including a plurality of antenna elements that extend substantially across an entire width of the window, said antenna grid further including first and second end bus bars connecting the antenna elements at opposite ends, vertical center elements connecting the antenna elements at a central location, and a tuning grid, said tuning grid including two vertical tuning elements connected to the antenna elements and a tuning stub connected to the vertical tuning elements, wherein a first and second antenna element of the antenna grid are separated and connected together by first and second vertical connecting antenna elements, said antenna grid further including an L-shaped element connected to the first bus bar and a T-shaped element connected to one of the vertical center elements.

10. The antenna system according to claim 9 wherein the antenna elements are separate elements than heater elements of a heater grid embedded in the vehicle window, said L-shaped element extending between the antenna grid and the heater grid and the T-shaped element extending between the antenna grid and the heater grid.

11. The antenna system according to claim 9 further comprising a matching circuit, said matching circuit being electrically connected to the antenna grid and being responsive to signals received by the antenna elements, wherein the matching circuit includes an antenna input, an AM output, an FM output, and a ground connection, said matching circuit further including a first capacitor connected between the AM output and the FM output, and a second capacitor and an inductor connected between the FM output and the ground connection.

12. An antenna system for a vehicle radio of a vehicle, said antenna system comprising:

an antenna grid embedded in a vehicle window of the vehicle, said antenna grid including a plurality of antenna elements that extend substantially across an entire width of the window, said antenna grid including first and second end bus bars connecting the antenna elements at opposite ends, wherein a first antenna element of the plurality of antenna elements is broken between the first and second end bus bars so that the first element is not continuous between the bus bars and a second antenna element of the plurality of antenna elements is broken between the first and second end bus bars so that the second element is not continuous between the bus bars, said second element being adjacent to the first element, said first and second antenna elements being connected together by first and second vertical connecting elements where they are broken, and wherein the antenna elements are separate elements than heater elements of a heater grid embedded in the vehicle window; and a matching circuit, said matching circuit being electrically connected to the antenna grid and being responsive to signals received by the antenna elements.

13. The antenna system according to claim 12 wherein the antenna system is tuned to an FM frequency range from 76 MHz to 108 MHz.

14. The antenna system according to claim 12 wherein the antenna grid further includes an L-shaped element extending between the antenna grid and the heater grid, and a T-shaped element extending between the antenna grid and the heater grid.

15. The antenna system according to claim 12 wherein the heater grid includes first and second shorting bars connecting heater elements of the heater grid at a central location.

16. An antenna system for a vehicle radio of a vehicle, said antenna system comprising:

an antenna grid embedded in an upper portion of a rear window of the vehicle, said antenna grid being separate from a heater grid embedded in a lower portion of the vehicle window, said antenna grid including a plurality of antenna elements that extend substantially across an entire width of the window, said antenna grid further including first and second end bus bars connecting the antenna elements at opposite ends, vertical center elements connecting the antenna elements at a central location, and a tuning grid, said tuning grid including two vertical tuning elements connected to the antenna elements and a tuning stub connected to the vertical tuning elements, said antenna grid further including an L-shaped element connected to the first bus bar and extending between the antenna grid and the heater grid, and a T-shaped element connected to one of the vertical center elements and extending between the antenna grid and the heater grid, wherein a first and second antenna element of the plurality of antenna elements are separated and connected together by first and second vertical connecting elements, said heater grid including first and second shorting bars connecting heater elements of the heater grid at a central location, said antenna grid being tuned to an FM frequency range from 76 MHz to 108 MHz; and a matching circuit, said matching circuit being electrically connected to the antenna grid and being responsive to signals received by the antenna elements, said matching circuit including an antenna input, an AM output, and FM output, and a ground connection, said matching circuit further including a first capacitor connected between the AM output and the FM output, and a second capacitor and an inductor connected between the FM output and the ground connection, said matching circuit being impedance matched to the antenna grid.

17. The antenna system according to claim 12 wherein the matching circuit includes an antenna input, an AM output, an FM output and a ground connection, said matching circuit further including a first capacitor connected between the AM output and the FM output, and a second capacitor and an inductor connected between the FM output and the ground connection.

18. The antenna system according to claim 12 wherein the antenna grid includes a tuning grid, said tuning grid including two vertical tuning elements connected to the antenna elements and a tuning stub connected to the vertical tuning elements.

* * * * *